United States Patent [19]

Kolmes et al.

[11] Patent Number: 4,777,789

[45] Date of Patent: Oct. 18, 1988

[54] WIRE WRAPPED YARN FOR PROTECTIVE GARMENTS

[76] Inventors: Nathaniel H. Kolmes, 1740 5th Street Dr. N.W., Hickory, N.C. 28601; Harold F. Plemmons, Route 1, Box 628, Millers Creek, N.C. 28651

[21] Appl. No.: 915,140

[22] Filed: Oct. 3, 1986

[51] Int. Cl.[4] ..... D02G 3/12; D02G 3/36; A41D 19/00

[52] U.S. Cl. ..... 57/210; 57/211; 57/230; 57/902; 2/167

[58] Field of Search ..... 57/210, 211, 212, 216, 57/224, 230, 229, 902, 235, 232, 901; 2/167

[56] References Cited

U.S. PATENT DOCUMENTS

| | | | |
|---|---|---|---|
| 1,574,004 | 2/1926 | Ryder | 57/224 X |
| 2,609,653 | 9/1952 | Peterson | 57/213 X |
| 3,336,744 | 8/1967 | Peene | 57/213 X |
| 4,202,382 | 5/1980 | Westhead | 57/210 X |
| 4,290,260 | 9/1981 | Wasserman | 57/210 |
| 4,313,998 | 2/1982 | Pivot et al. | 57/229 |
| 4,350,731 | 9/1982 | Siracusano | 57/210 X |
| 4,384,449 | 5/1983 | Byrnes et al. | 57/210 |
| 4,458,475 | 7/1984 | Schmit et al. | 57/902 X |
| 4,470,251 | 9/1984 | Bettcher | 2/167 X |

*Primary Examiner*—Donald Watkins
*Attorney, Agent, or Firm*—Jerold I. Schneider

[57] ABSTRACT

An improved yarn, fabric and protective garment made from such yarn where the yarn, fabric and garment exhibit increased cut resistance. The yarn includes a core made of fiber and a covering wrapped around the core, the covering includes at least one strand of wire wrapped around the core.

9 Claims, 1 Drawing Sheet

WIRE WRAPPED YARN FOR PROTECTIVE GARMENTS

CROSS REFERENCE TO RELATED APPLICATIONS

This application contains subject matter which is common to our copending applications "Improved Yarn" Ser. No. 766,855, filed Aug. 16, 1985 and "Improved Protective Garment" Ser. No. 766,846, filed Aug. 16, 1985.

BACKGROUND OF THE INVENTION

The present invention relates generally to yarns, fabrics and protective garments using such yarns, and, more particularly, to an improved yarn which may be used to form an improved, more comfortable, more flexible protective garment.

In our prior applications we describe certain technological advantages of an extended chain polyethylene fiber when used in a yarn for a protective garment as compared to other fibers. In our prior applications we explained the use of a yarn having a core and a covering with the core including the combination of at least one strand of extended chain polyethylene fiber and one strand of wire, with the wire and fiber strands placed parallel to each other to form the core. The covering for the yarn, as described in our earlier applications, may be of materials such as extended chain polyethylene, nylon or other fibers.

The yarn and protective garment knitted therefrom, as described in our prior applications, exhibit numerous benefits as compared to the prior art yarn and prior art protective garment where the yarn contains the aramid fiber plus wire.

One of the benefits of the yarn as described in our prior applications was a resistance to being cut with a sharp instrument such as a knife. At the time of our prior invention, we believed that the combination of extended chain polyethylene and wire in the core of the yarn exhibited greater resistance than the combination of aramid plus wire in the core of the yarn and further believed that the improved cut-resistance or slash-resistance was attributable to the use of the extended chain polyethylene.

We have since discovered that while the use of the combination of the extended chain polyethylene together with a wire as the core for a covered yarn provided numerous benefits when compared to the use of the combination of aramid plus wire as the core for a yarn, that totally new and different approaches have resulted in an improved yarn and protective garment.

SUMMARY OF THE INVENTION

The present invention relates to a new and improved yarn, a method of making the yarn, and a garment made from the yarn. This is based on our discovery of an apparently new configuration for a cut resistant yarn to be utilized in a cut resistant protective garment. Based on our discovery, our invention allows substantially more wire to be utilized in the yarn than in the prior yarn configurations while taking into account the overall yarn diameter, thus, resulting in an increase in cut resistance without any meaningful loss in flexibility of the garment.

The yarn and garment according to the present invention have numerous advantages over the prior art commercially available yarns such as those made of aramid fiber or those made of extended chain polyethylene fiber, each of which has a wire in the core placed parallel to a fiber in the core. A substantial advantage is an increased cut resistance or slash resistance. An additional benefit includes the fact that the yarn according to the present invention, although it does include wire, is not substantially increased in thickness when compared to prior yarns. Thus the yarn according to the present invention may be utilized in connection with conventional knitting machines or weaving machines. Furthermore, the yarn of the present invention exhibits the desired benefits to be used in a protective garment such as light weight, flexibility, and numerous other advantages which heretofore may not have been readily available.

BRIEF DESCRIPTION OF THE DRAWINGS

The various benefits and advantages of the present invention will be more easily understood upon reading the following detailed description of the invention taken in conjunction with the drawings.

In the drawings, wherein like reference numerals identify corresponding components.

DETAILED DESCRIPTION OF THE INVENTION

Figure 1:
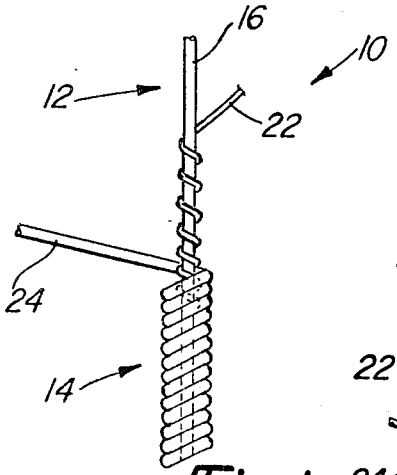
FIG. 1 is an illustration of yarn in accordance with the principles of the present invention.

With reference to the drawings, the improved yarn 10 of the present invention is illustrated in FIG. 1 as being formed of a core 12 and a covering 14. The core as illustrated in FIG. 1 includes a core strand 16 formed of a fiber. The fiber to be used in the core may be spun, monofilament or multifilament as will be explained in greater detail.

The covering 14 of the present invention includes at least one strand of wire 22 wrapped around the core. A preferred form of wire is annealed stainless steel grade 304 wire having a nominal diameter in the range of 0.0030–0.0060 inches. In fact the wire may be a single strand or may be multiple strands twisted or braided or otherwise combined. Multiple strands of wire may be wrapped around the core without the wires being combined together. If multiple strands of wire are wrapped around the core, the wraps should alternate in direction, that is, one may be clockwise and the next counterclockwise, etc., and the diameter may be reduced to about 0.0020 inch. The wire in FIG. 1 is illustrated as having been wrapped in a clockwise direction; obviously the wire could be wrapped in a counterclockwise direction. Wires other than stainless steel may be utilized, depending upon the ultimate utilization of the yarn. For example, if the yarn is to be used in a protective garment such as a glove, apron, sleeve or the like in the meat packing industry or other industries where there is contact with foods, then stainless steel is a preferred wire. If cut resistance is desired, the wire should be annealed to eliminate any residual magnetic properties since any magnetic properties could have a detrimental effect if a knife comes in contact with the yarn. Depending upon the desired degree of flexibility of the yarn and any final product made from the yarn, different diameters of wire may be utilized.

Referring back to FIG. 1, the covering includes a wrap 24 illustrated as wrapped in a direction opposite to the direction of wrap of the wire 22. The covering 24 may be a fiber and may be, but need not be, identical to the fiber utilized in the core.

Figure 2:
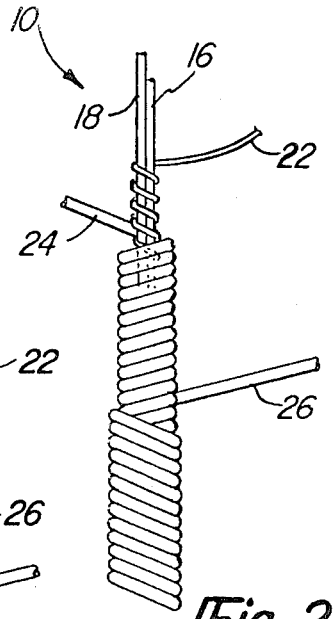
FIG. 2 is an illustration of a modified form of yarn in accordance with the principles of the present invention.

Prior to explaining the details of the various fibers which may be utilized in the yarn and protective garment of the present invention, reference should be had to FIG. 2 for an explanation of alternate forms of the present invention. FIG. 2 illustrates a yarn wherein the core 12 includes two strands 16, 18. The strands may both be of fiber which need not be identical. The covering 14 for the yarn illustrated in FIG. 2 includes an inner wrap of wire 22, an intermediate wrap 24 and a top wrap 26. The wire wrap is illustrated as being clockwise, wrap 24 is illustrated as being counterclockwise and wrap 26 is illustrated as being clockwise. The material of wraps 24 and 26 need not be identical. The wraps 22, 24 and 26 may be considered as three layers wrapped around the core. Two of the wraps, e.g., 22 and 24, may both be wire.

It should be appreciated that once the principles of our wire wrap are understood, there are numerous modifications which may be made while still obtaining the benefits of the present invention. For example, the core may be reinforced with a wire if desired. Thus in the embodiment of FIG. 2, one strand could be fiber and the other strand could be wire. Whatever the material of the two strands they may be placed parallel to each other or combined such as via twisting or braiding. The three wraps of FIG. 2, that is 22, 24 and 26, may all be in the same direction, such as clockwise; the wire wrap need not be the innermost wrap but rather the wire wrap could be the intermediate wrap or even part of the outer wrap. If a polyester or fiber bottom wrap is used, it tends to aid in holding all the covering onto the core.

Figure 5:
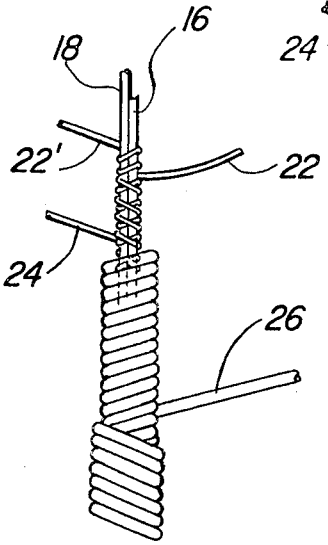
FIG. 5 is an illustration of another modified form of yarn in accordance with the principles of the present invention.

FIG. 5 illustrates, as a further example, parallel core strands 16, 18, one of which may be wire, an inner wrap or inner covering 22, 22', comprising wire 22 wrapped in a first direction around the core and wire 22' wrapped in the opposite direction around the core, and outer wrap or outer covering strands 24, 26 with the strands, 24, 26 being preferably fiber strands wrapped in opposite directions relative to each other around the core.

The fiber to be utilized in the core of the present invention need not be identical to the fiber utilized in the covering or wrap. Thus according to the principles of the present invention, the covering of the yarn may be made of materials to enhance comfort, reduce skin abrasion and the like whereas the core fiber may be selected based upon other considerations.

A preferred form of yarn according to the present invention utilizes a 1260 denier nylon core, an inner wire wrap or covering of 0.0040 inch diameter annealed stainless steel 304 wire covered by another wrap of 1260 denier nylon. Nylon is preferred. The pitch of the wire wrapped around the core may be generally in the range of 2–24 turns per inch. Such a pitch is sufficient as may be explained by the following hypothetical. Consider a glove 30 of FIG. 3 knitted of yarn as just described. As a knife comes in contact with the yarn, if the knife blade is applied against one yarn just between two turns of wire, then the knife blade will contact the wire in one location only, on the underside of the yarn, whereas if the knife blade is placed in any other position the blade will contact wire in at least two places. Thus, it is possible but highly improbable that there will be only one point of contact between the knife blade and the wire from a single strand of yarn. This is to be contrasted with prior yarns having a strand of wire only in the core where there is only one point of contact between the knife blade and the wire itself. If two wire wraps are used, the pitch may be reduced to as low as two turns per inch, per wire. If there are too many turns per inch, whether one or more wires are used, the wire impacts excessive torque on the yarn, thus interfering with the knitting process.

Having described a preferred form of yarn, the process for manufacturing the yarn should be explained in greater detail. Although a conventional wire covering machine may be utilized, it is desirable, depending upon the yarn being used, to autoclave or pre-shrink the fibers. Then, as part of the covering of the fiber to make the yarn, the fiber which comprises the core is placed in slight tension; then the covering or wraps are placed on the fiber core. This tensioning of the core provides an effect similar to an automobile shock absorber.

According to the principles of the present invention, numerous fibers which are commercially available may be incorporated in the yarn as long as the principle of the wire covering is employed. As indicated previously, the fiber used in the core need not be identical with the fiber used in the covering for any particular style of yarn and, furthermore, when there are multiple fiber coverings, or multiple fibers in the core, such as in FIG. 2, the fibers need not be identical. The commercially available fibers which we have utilized, separately and in some combinations, include an aramid such as Kevlar, (manufactured by Dupont) an extended chain polyethylene such as Spectra, (manufactured by Allied), wool, Fiberglass (manufactured by PPG), Dacron polyester (manufactured by Dupont), polyester manufactured by Celanese Corporation, nylon 6, nylon 66, cotton, asbestos and polycotton blend. The fiber may be spun or filament. If the fiber is of the filament type, the denier may be the commercially available deniers such as the 210, 420, 500, 610, 650, 800, 840, 1000, 1200, 1260, and 1500, which are nominally identified as 200–1500 denier. Spun fibers which have been evaluated, alone and in some combinations, include cotton, extended chain polyethylene, aramid and polycotton blend with the count including 16/1, 20/1, 24/1, 12/2, 16/2, 20/2, and 40/3. The reason for explaining the foregoing varieties of materials tested is to demonstrate that one important factor of the present invention is the utilization of the wire wrapping.

Figure 3:
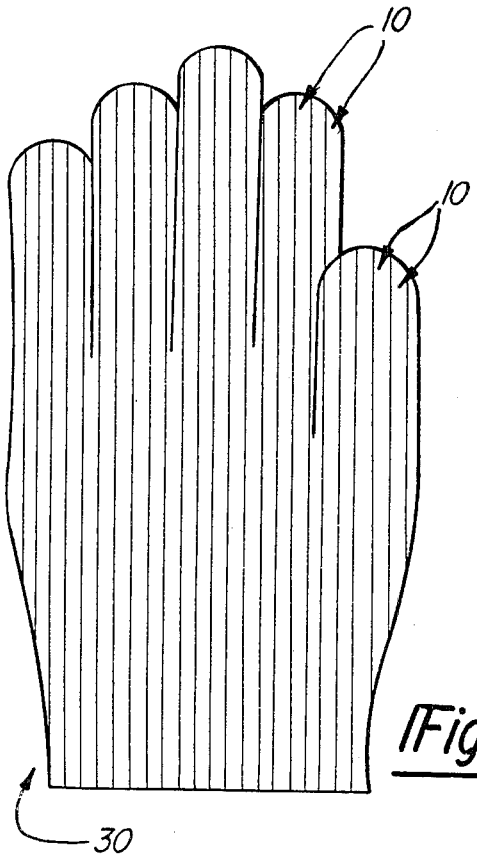
FIG. 3 is an illustration of a protective garment, namely a glove, made in accordance with the principles of the present invention.

Referring to FIG. 3 of the present invention, a protective garment such as a glove 30 may be knit using one or more ends of yarn with each of the ends of yarn being made according to the principles of the present invention. In addition, the protective glove 30 may be knit from a plurality of ends of yarn where only one end is made according to the principles of the present invention and other ends of yarn may be differently formed to provide other benefits. For example, one end of yarn according to the principles of the present invention and a second end of yarn made solely of extended chain polyethylene may be knit together on a conventional knitting machine to provide a glove having increased thermal insulative properties.

Figure 4:
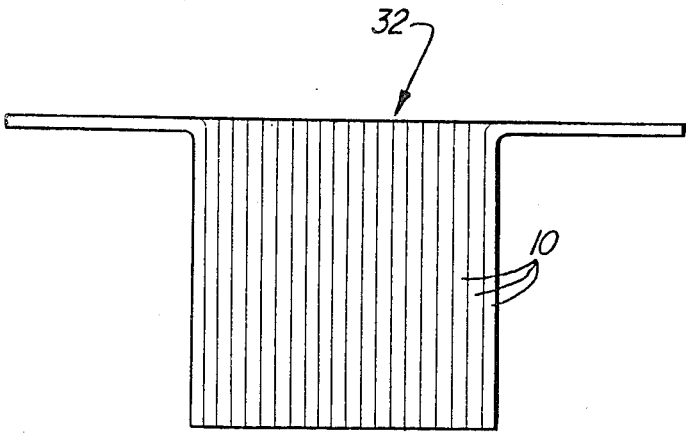
FIG. 4 is an illustration of another type of protective garment utilizing the yarn of the present invention.

Other protective garments may be knit utilizing the yarn of the present invention and, for example, conventional knitting machines may be utilized to knit the yarn into a fabric to be used for a cut resistant apron, arm protector or sleeve, leg and foot protectors, head protectors or the like. FIG. 4 illustrates, in general, a protective garment 32.

It should further be understood and appreciated that the yarn according to the present invention, may be woven into a fabric. The fabric may be formed into protective garments such as impact or bullet resistant vests, and also may be utilized in other high strength products. While the function of the wire as being cut resistant is of course understood, there appears to be some reinforcing which is accomplished between the wire and the fibers such that each contributes to the overall strength of the other in a yarn in the natue of a mutual reinforcement. Thus the yarn according to the present invention, has numerous applications other than protective garments per se where high strength is desired.

The foregoing is a complete description of the present invention. Various changes and modifications may be made without departing from the spirit and scope of the present invention. The invention, therefore, should be limited only by the following claims.

What is claimed is:

1. A yarn for use in making strong, flexible products comprising:

a core including at least one wire strand and at least one fiber strand positioned parallel to the wire strand in the core;

a covering wrapped on said core, said covering including at least two fiber strands wrapped in opposite directions, relative to each other around the core; and at least two additional wire strands wrapped in opposite directions relative to each other around the parallel positioned strands.

2. The invention as defined in claim 1 wherein the covering includes one or more fibers selected from the group consisting of nylon, aramid, extended chain polyethylene, cotton, wool, fiberglass, polyester, polycotton, asbestos.

3. The invention as defined in claim 1 wherein the core includes one or more fibers selected from the group consisting of nylon, aramid, extended chain polyethylene, cotton, wool, fiberglass, polyester, polycotton, asbestos.

4. The invention as defined in any one of claims 1, 2 or 3 where the fiber is a filament.

5. The invention as defined in any one of claims 1, 2 or 3 wherein the fiber is spun.

6. The invention as defined in any one of claims 1, 2 or 3 wherein the covering includes at least two strands of dissimilar fibers.

7. A protective garment knitted of a yarn, said yarn being made in accordance with any one of claims 1, 2 or 3.

8. A fabric formed of a yarn, said yarn being made in accordance with any one of claims 1, 2 or 3.

9. A glove formed of a yarn, said yarn being made in accordance with any one of claims 1, 2 or 3

* * * * *